US008714605B1

(12) United States Patent
Coratola et al.

(10) Patent No.: US 8,714,605 B1
(45) Date of Patent: May 6, 2014

(54) ASSEMBLY FOR EXERTING A FORCE ON A ZIPPER AND METHOD OF USE

(71) Applicant: Zip Me Up Products, LLC, Dublin, OH (US)

(72) Inventors: Terri A. Coratola, Dublin, OH (US); Michelle C. Lucero, Dublin, OH (US)

(73) Assignee: Zip Me Up Products, LLC, Dublin, OH (US)

( * ) Notice: Subject to any disclaimer, the term of this patent is extended or adjusted under 35 U.S.C. 154(b) by 0 days.

(21) Appl. No.: 13/654,045

(22) Filed: Oct. 17, 2012

(51) Int. Cl.
*A47G 25/90* (2006.01)

(52) U.S. Cl.
USPC ..... 294/3.6; 242/385.4

(58) Field of Classification Search
USPC ..... 294/3.6; 24/429, 431; 223/111; 242/384.7, 385.4
See application file for complete search history.

(56) References Cited

U.S. PATENT DOCUMENTS

| | | | | | |
|---|---|---|---|---|---|
| 1,831,666 | A | * | 11/1931 | Jacobia | 242/385.4 |
| 2,185,853 | A | * | 1/1940 | Knoess | 24/429 |
| 2,908,057 | A | * | 10/1959 | Blanco | 24/3.13 |
| 2,965,945 | A | * | 12/1960 | Lazich | 294/3.6 |
| 2,974,991 | A | * | 3/1961 | Gerrick et al. | 294/3.6 |
| 3,409,322 | A | * | 11/1968 | Albanese et al. | 16/430 |
| 4,067,487 | A | * | 1/1978 | Carr et al. | 223/111 |
| 5,245,761 | A | * | 9/1993 | Waldherr | 242/384.7 |
| 5,388,877 | A | * | 2/1995 | Wenk | 294/219 |
| 6,243,921 | B1 | * | 6/2001 | Chang | 24/3.13 |

* cited by examiner

*Primary Examiner* — Dean Kramer
(74) *Attorney, Agent, or Firm* — Standley Law Group LLP

(57) ABSTRACT

A device to assist with the working of a zipper is described herein. The device includes a retractor body and a retractable clasp connected to the retractor body with a flexible member. The retractor body has a brake system in order to maintain a desired length of a flexible member. A removable decorative cap is also applied to the retractor body.

17 Claims, 5 Drawing Sheets

ASSEMBLY FOR EXERTING A FORCE ON A ZIPPER AND METHOD OF USE

CROSS-REFERENCE TO RELATED APPLICATIONS

This application claims priority to U.S. Application No. 61/547,997, filed Oct. 17, 2011, and is incorporated herein as if fully rewritten.

TECHNICAL FIELD

Exemplary embodiments of the present invention relate to a device to assist with the donning of an article of clothing. More particularly, exemplary embodiments of the present invention relate to devices for assisting a user in zipping and unzipping an article of clothing.

BACKGROUND

The use of zippers in articles of clothing began over 80 years ago. The zipper was first used in children's clothing as way to promote self sufficiency, by allowing younger children to dress themselves. Over the years the zipper has become one of the most popular types of closures in the clothing industry and can be found on everything from formal evening gowns to rugged overalls. While many different types of zippers have been developed, the general idea of a slider having a pull tab to bring together two rows of teeth has remained the same.

Although, the first use of the zipper was to assist young children, the zipper also has drawbacks. Zippers that are placed in the rear of clothing are often difficult to use. In addition, as one gets older it also becomes increasingly difficult to use a zipper due to such ailments as arthritis. While products have been devised to assist with the use of zippers, most have hooks and attachment devices that might not be used with all types of zippers. Also, these products often have a static length of string or wire limiting their usefulness.

SUMMARY OF THE INVENTIVE CONCEPT

Consequently, exemplary embodiments of the inventive concept have the objective to overcome the drawbacks of the prior art, in particular to provide a simple, effective, and decorative device to assist a user in use of a zipper. Exemplary embodiments of the assembly and device of the inventive concept include a retractor body, a clasp, and a retractable string or wire connected to the clasp and stored in the retractor body. The wire is wound around a spool within the retractor body for storage. A spring is also in the retractor body and applies a bias to the spool to maintain the wire within the retractor body in a retracted state.

To prevent the rotational motion of the spool, thus preventing the wire from being retracted or advanced, a brake system is provided. The brake system includes a brake lever housed within the retractor body and a brake pad extending though the retractor body. To apply the brake, a user depresses the brake pad, which in turn acts upon the brake lever. When acted upon, the brake lever interacts with the spool to prevent rotational motion and maintain the wire at a desired length.

In order to grab a zipper pull tab or slider, the clasp has a jaw including a top and bottom portion. The top and bottom jaws of the clasp have teeth. When the clasp is in a closed position the teeth of the jaws complementarily engage each other. This arrangement of teeth provides sufficient grip to withstand the force applied to the clasp while moving the zipper slider.

A decorative cap is provided to allow a user to accessorize the device. The decorative cap snaps-on or is otherwise removably attached to the retractor body. This removable feature allows for the exchange of one decorative cap for another to coordinate with different outfits and styles. In other exemplary embodiments the decorative cap is permanently attached to the retractor body. In this embodiment the decorative cap may be press fit or adhered onto the retractor body.

BRIEF DESCRIPTION OF THE DRAWINGS

In addition to the features mentioned above, other aspects of the present invention will be readily apparent from the following descriptions of the drawings and exemplary embodiments, wherein like reference numerals across the several views refer to identical or equivalent features, and wherein.

DETAILED DESCRIPTION OF THE EXEMPLARY EMBODIMENTS

Exemplary embodiments of the present invention will now be described in greater detail. It should be recognized that the present invention can be practiced in a wide range of other embodiments besides those explicitly described, and the scope of the exemplary embodiments described are expressly not limited.

Figure 1:
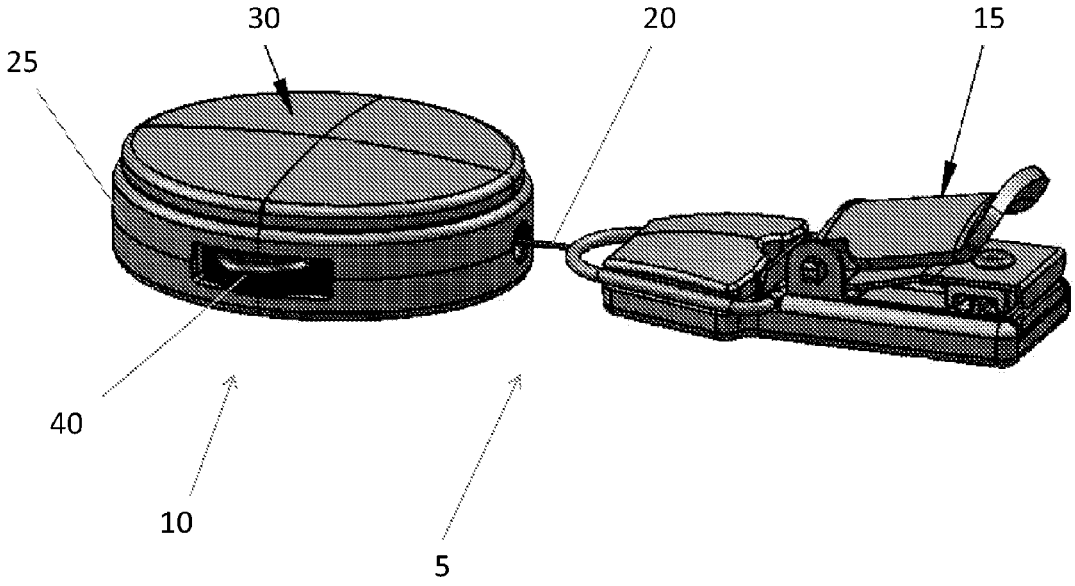
FIG. 1 is a perspective view of an exemplary embodiment of an assembly for exerting a force on a zipper slider.
Figure 2:
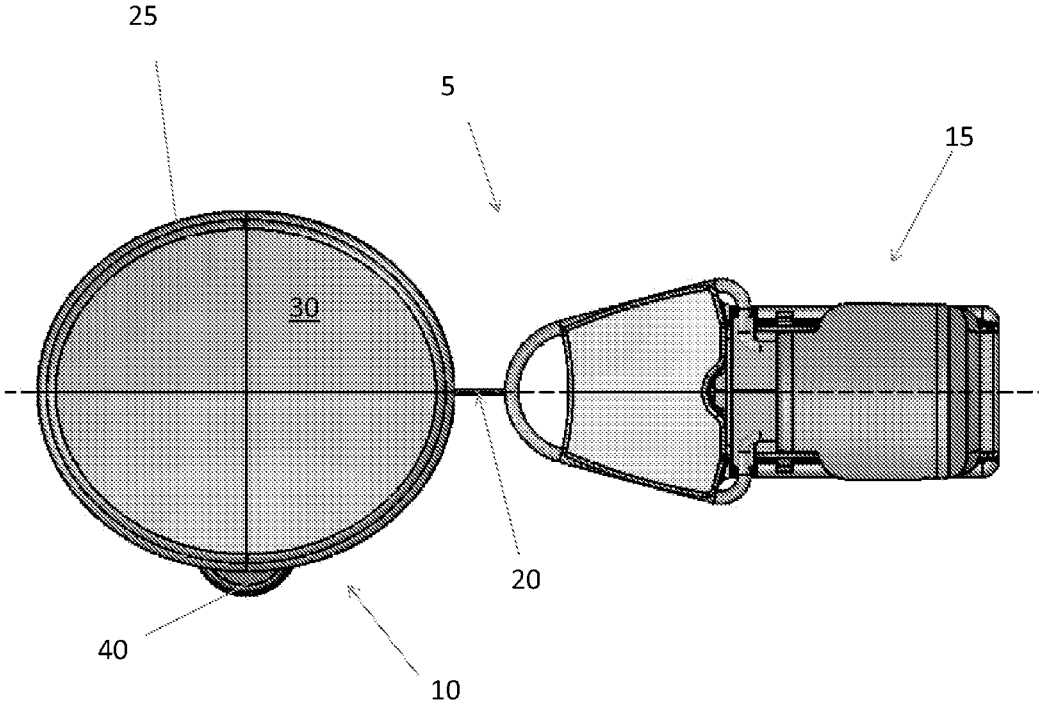
FIG. 2 is a top view of an exemplary embodiment of an assembly for exerting a force on a zipper slider.
Figure 3:
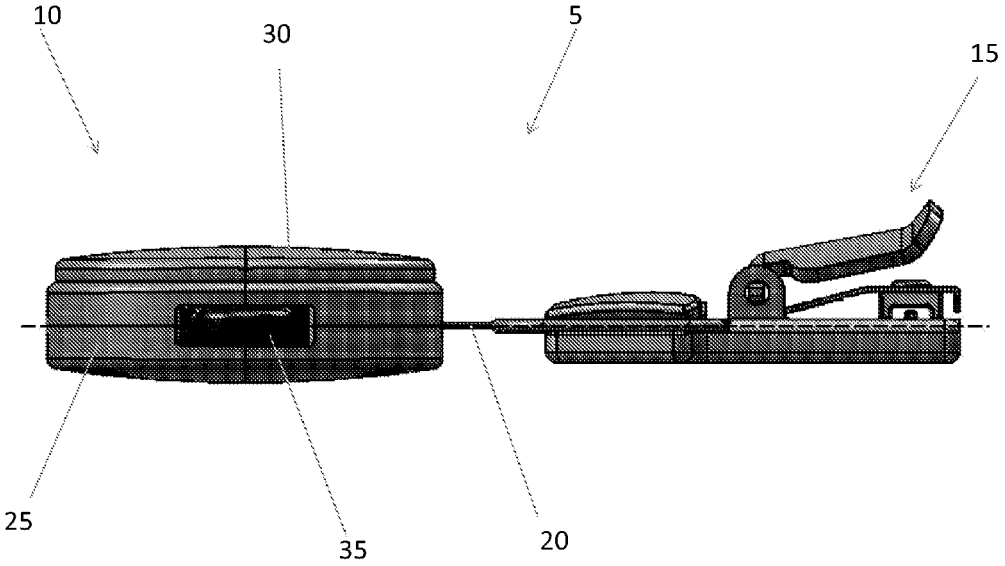
FIG. 3 is a side view of an exemplary embodiment of an assembly for exerting a force on a zipper slider.

Directing attention to the drawings and particularly to FIG. 1, a perspective view is provided for an embodiment of an assembly 5 for exerting a force on a zipper slider according to the inventive concept. FIGS. 2 and 3 provide a top view and a side view respectively of the assembly 5 according to the inventive concept. As shown in FIGS. 1-3, the assembly 5 includes a body 10 and a clasp 15 attached to one another with a flexible member 20 such as a string or wire. In particular, it was discovered that twisted multi-strand metal wire having a vinyl covering worked well as the flexible member 20. Although the body 10 is shown having an ovoid shape, one of skill in the art would appreciate that the body 10 may have a variety of shapes, including, but not limited to, square, circular, and triangular.

The body 5 includes a housing 25, a decorative cap 30, and a brake 40 protruding from the housing 25. The decorative cap 30 is removably attached to the top of the housing 25 allowing for quick and easy changes between different decorative caps 30 to match the user's clothing or other accessories. The housing is connected to the clasp 15 by the flexible member 20. A retracing mechanism 60 (discussed in relation to FIG. 4) is located in the housing 25 and is used to retract a length of the flexible member 20 back into the housing 25 after or during use of the assembly 5. The brake 40 is in communication with this retracing mechanism and protrudes through the housing 25. When engaged, the brake 40 prevents the flexible member 20 from either being retracted or extended out of the housing 25. Accordingly, being able to predetermine the length of the flexible member 20, by using the brake 40, the assembly 5 is more versatile than prior devices.

The clasp 15 is affixed to the flexible member 20. The clasp 15 (discussed more fully below) is used to attach the assembly 5 to a zipper slider. The user can control the distance between the clasp 15 and the housing 25 by using the brake 40.

Figure 4:
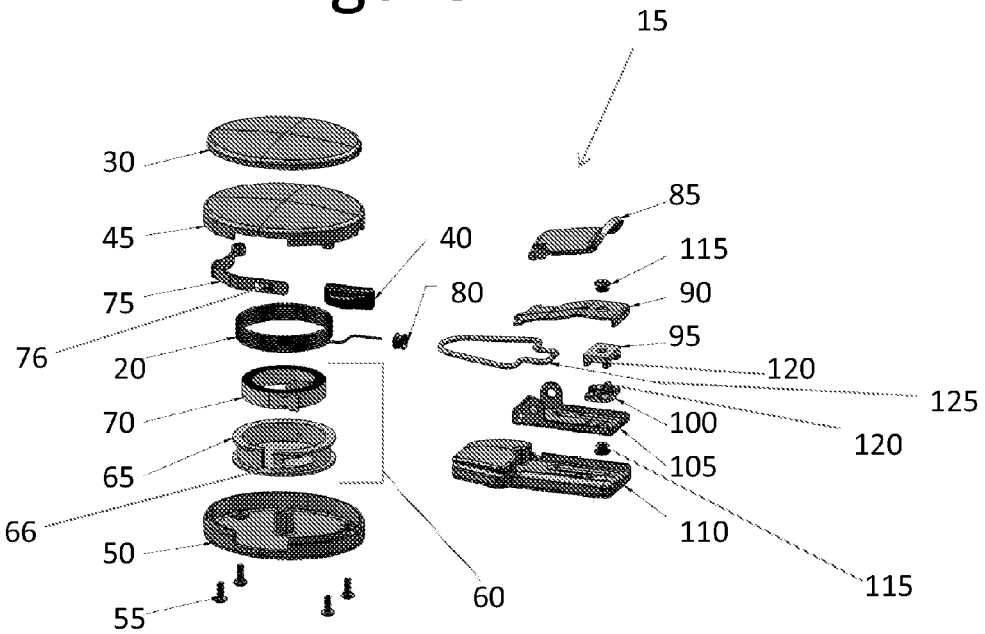
FIG. 4 is an exploded view of an exemplary embodiment of an assembly for exerting a force on a zipper slider.

Turning attention now to FIG. 4, an exploded view of the assembly 5 is provided. As shown in FIG. 4, the housing 25 has a top portion 45 and a bottom portion 50 and may be held together by mechanical fasteners 55. Although mechanical fasteners 55 provide the advantage of granting access to the interior of the housing 25 should repair be necessary, it should be understood that adhesives or an interlocking feature may also be used to connect the top portion 45 to the bottom portion 50. The top portion 45 is adapted to easily and quickly mate with the decorative cap 30. This may be accomplished with a snap or other interlocking feature. In still other exemplary embodiments, the decorative cap 30 may be permanently affixed or press fit to the top portion 45. A permanently affixed decorative cap 30 would prevent its accidental removal and ensure a pleasant esthetic for the assembly 5.

As stated above, a retractor mechanism 60 is located in the housing 25 and includes a spool 65 and a spring 70. The flexible member 20 is wound around the spool 65 and the spring 70 provides a bias on the spool 65 so that the flexible member 20 is retracted around the spool 65 when at rest. The flexible member 20 is advanced from the spool 65 by simply pulling the flexible member 20 or clasp 15 away from the housing 25.

Figure 5:
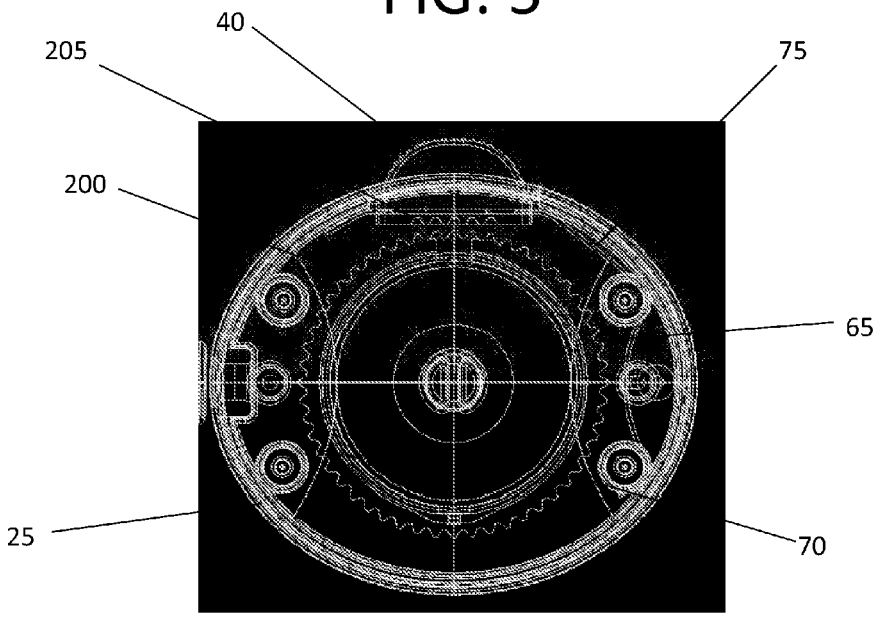
FIG. 5 is a cross-sectional view of another exemplary embodiment of the assembly for exerting a force on a zipper slider.

Also included in the housing 25 is a brake spring 75 in communication with the brake 40 (illustrated in FIG. 5). The brake spring 75 is held in place in the housing 25 and at rest exerts a force outward on the brake 40 protruding from the housing 25. Once a force is applied inward on the brake 40, the brake 40 applies pressure to the brake spring 75 forcing the brake spring 75 to interact with the retraction mechanism 60.

Specifically, the brake spring 75 may have a catch 76 thereon that engages with a receiver 66 in the spool 65. The nesting of the catch 76 within the receiver 66 prevents rotational motion of the retraction mechanism 60, thus preventing the retraction or advancement of the flexible member 20. To allow movement of the retraction mechanism 60, the force is simply removed from the brake 40 and the brake spring 75 disengages from the spool 65. The bias on the brake spring 75 then returns the brake 40 to its original position. In other exemplary embodiments of the assembly 5, the brake spring 75 may not have a catch 66, but rather the pads (not shown) may be positioned on the brake 40. When depressed, the pads on the brake 40 would then contact the spool 65 and would prevent rotational movement thus preventing the retraction or advancement of the flexible member 20.

To ensure easy retraction and advancement of the flexible member 20 without snagging on the housing 25, the flexible member 20 is threaded through a ferrule 80 held in place by the top and bottom portions 45, 50 of the housing 25. The ferrule 80 may be constructed from a metal or plastic material that can withstand the friction created by the retraction and advancement of the flexible member 20.

The clasp 15 is also shown in greater detail in FIG. 4. As illustrated, the clasp 15 includes a lever 85, a plate 90, top and bottom jaw portions 95, 100, a base 105, and a bezel 110. The top jaw 95 is secured to the plate 90 by a rivet 115. Although a rivet 115 is contemplated, one of ordinary skill in the art would recognize that other mechanical fasteners may be used, in addition to adhesives and other connective means. Teeth 120 are provided on both the top and bottom jaws 95, 100 and complementarily engage another when brought into physical contact. The complementary engagement of the teeth 120 ensures that the clasp 15 can securely grasp a pull tab or slider of a zipper. The teeth 120 are constructed to grasp a zipper slider and to prevent slipping once the clasp 15 is engaged. During experimentation, it was discovered that teeth 120 running the width of the jaw 95, 100 and in a parallel arrangement would provide the best grip of a zipper slider. Likewise, the parallel rows of teeth 120 on the top and bottom jaws 95, 100 should be slightly offset one to another so that maximum pressure may be applied to the zipper slider. The teeth 120 may be made from rubber, plastic or other high friction material. Specifically, to provide maximize gripping force to the zipper slider the rubber has a durometer measurement of Shore 80A, although it should be understood that rubbers having a different shore measurement may be used. However, "softer" rubbers or those having a substantially lower durometer may compromise the integrity of the clasp and easily slip off a variety of zipper sliders or pulls.

The bottom jaw 100 is secured to the base 105 using a rivet 115. As discussed herein, one of ordinary skill would appreciate that other attachment means may be employed. The base 105 is securely fixed in the bezel 110.

To connect to the flexible member 20, the clasp 15 has a wire frame 125 sandwiched between the plate 90 and the base 105. The wire frame 125 is further secured to the clasp 15 by snapping onto the bezel 110. A lever 85 is provided to move the plate 90 and the affixed top jaw portion 95 from an open to a closed position and back again.

When the lever 85 is lifted, the plate 90 is also lifted and disengages the top jaw portion 95 from the bottom jaw portion 100. Once in this open position, a zipper pull tab or slider is inserted between the jaws 95, 100 and the lever 85 is depressed thus clamping the pull tab or slider between the jaws 95, 100.

In the embodiment shown in FIG. 4, the lever 85 is attached to the base 105 and has an open and closed position. When the lever is in a closed position it exerts a force on the top jaw 95 forcing the top jaw 95 toward the bottom jaw 100 to as to hold a zipper slider. When the lever 85 is placed in the open position there is no force applied to the top jaw 95 allowing the top jaw 95 to move away from the bottom jaw 100 to allow the removal of the zipper slider from between the jaws 95, 100.

FIG. 5 illustrates an exemplary assembly 5 having a cogged brake assembly. In this embodiment, the brake 40 has a series of teeth 205. Likewise, the exterior of the spool 65 resembles a cogwheel being circumnavigated in a series of teeth 200. The teeth 200, 205 on the brake 40 and the spool 65 are designed for complementary engagement when a force is applied to the brake 40 forcing physical contact between the spool 65 and brake 40. The complementary engagement of the cog teeth 200, 205 prevents rotational motion of the spool 65. Once the force is removed from the brake 40, the brake spring 75 returns the brake 40 to its starting location allowing the spool 65 to move rotationally.

To use the assembly 5, a user simply opens the clasp 15 by lifting the lever 85. The open jaws 95, 100 are then placed around a zipper pull tab or slider and the jaws 95, 100 are then closed by depressing the lever 85. Once the clasp 15 has been closed on the zipper element, the user may put on the article of clothing if not already done. The user then grasps the body 10 of the assembly 5 and advances the flexible member 20 by pulling the body 5 away from the clasp 15 until it is comfortable for the user to begin closing the zipper.

Once a comfortable position has been reached, the brake 40 is depressed preventing further advancement of the flexible member 20. The user then pulls the body 5 in the direction they wish the zipper pull tab or slider to travel. This application of force to the zipper pull tab or slider causes the zipper to close as the slider moves along the zipper edges. If the zipper is not fully closed then the user may release the brake 40 and retract a portion of the flexible member 20 into the body 10 and again depress the brake 40 and continue to close the zipper. After the zipper is fully closed, the user simply releases the brake 40 and retracts the flexible member 20 into the body 10 and removes the clasp 15 from the zipper pull tab or slider by lifting the lever 85.

While certain embodiments of the present invention are described in detail above, the scope of the invention is not to be considered limited by such disclosure, and modifications are possible without departing from the spirit of the invention as evidenced by the following claims:

What is claimed is:

1. An assembly for exerting a force on a zipper, comprising:

a retractor body, said retractor body having a retractor mechanism therein, said mechanism includes a spool and a spring, said spool retaining a flexible member in said retractor body;

a brake system included in said retractor body and extending therefrom, said brake system includes a brake protruding through said retractor body and a brake spring inside said retractor body, wherein when said brake is depressed said brake spring prevents rotational motion of said spool, said brake spring applies a bias to said brake preventing said brake or said brake spring from contacting said spool when at rest;

a clasp, said clasp attached to said retractor body by way of said flexible member; and a decorative cap attached to said retractor body.

2. The assembly of claim 1, wherein said retractor body includes a top portion and a bottom portion, wherein said top portion is adapted to removably attach to said decorative cap.

3. The assembly of claim 1, wherein said clasp includes a top jaw and a bottom jaw each having teeth thereon.

4. The assembly of claim 3, wherein said top jaw is fastened to a plate and said bottom jaw is fastened to a base.

5. The assembly of claim 2, wherein said spool has cogs running along its exterior circumference.

6. The assembly of claim 5, wherein said brake has a series of teeth adapted to engage with said cogs on said spool when the brake and the spool are brought into physical contact preventing rotational motion of said spool.

7. The assembly of claim 1, wherein said flexible member is a metal wire.

8. An assembly for exerting a force on a zipper, comprising:

a retractor body, said retractor body including:

a housing having a top portion and a bottom portion;

a spool for receiving a flexible member;

a spring, said spring exerting a bias on said spool;

a brake system for preventing rotational motion of said spool, said brake system including a brake spring and a brake extending from said housing;

a clasp attached to said flexible member, including:

a top jaw mechanically fixed to a plate;

a bottom jaw portion mechanically fixed to a base;

a bezel adapted to receive said base;

a wire frame interposed between said plate and said base adapted to attach to said flexible member; and teeth arranged on said top and bottom jaws so as to be in complementary engagement when the clasp is in a closed position.

9. The assembly of claim 8, further comprising a decorative cap permanently attached to said top portion of said housing.

10. The assembly of claim 8, further comprising a decorative cap removably attached to said top portion of said housing.

11. The assembly of claim 8, further comprising cogs along the exterior circumference of said spool.

12. The assembly of claim 11, further comprising a series of teeth on said brake adapted to engage said cogs on said spool when said brake is in physical contact with said spool.

13. An assembly for exerting a force on a zipper, comprising:

a housing having a top portion and a bottom portion, said top portion and said bottom portion fastened one to another;

a retractor mechanism retained in said housing, including:

a spool for retaining a flexible member, said spool having cogs along its exterior circumference;

a spring affixed to said spool for applying a rotational motion to said spool;

a braking system retained in said housing, said braking system including:

a brake extending through said housing having teeth thereon, said teeth adapted for complementary engagement with said cogs on said spool to prevent rotation motion when said brake is in physical contact with said spool;

a brake spring, said brake spring held within housing and applies a force on said brake to prevent physical contact between said brake and said spool when at rest;

a clasp having a base, said clasp connected to said flexible member by a wire frame affixed to said clasp, said clasp including:

a top jaw and a bottom jaw each having a series of complementary teeth so as to grasp a zipper slider;

a lever attached to said base, said lever applying a force to said top jaw moving said top jaw into contact with said bottom jaw when said lever is in a closed position and removing said force when in an open position.

14. The assembly of claim 13, wherein said flexible member is a wire.

15. The assembly of claim 14, wherein said wire is a twisted multi-strand wire having a vinyl covering.

16. The assembly of claim 13, further comprising a decorative cap, said decorative cap removably attached to said top portion of said housing.

17. The assembly of claim 13, wherein said series of complementary teeth on the top and bottom jaws are rubber having a durometer of shore 80A.

* * * * *

UNITED STATES PATENT AND TRADEMARK OFFICE

CERTIFICATE OF CORRECTION

PATENT NO. : 8,714,605 B1
APPLICATION NO. : 13/654045
DATED : May 6, 2014
INVENTOR(S) : Terri A. Coratola and Michelle C. Lucero It is certified that error appears in the above-identified patent and that said Letters Patent is hereby corrected as shown below:

In the Claim

In column 5, line 43, delete "5. The assembly of claim 2," and insert --5. The assembly of claim 1,--.

Signed and Sealed this
First Day of July, 2014

Michelle K. Lee

Michelle K. Lee
*Deputy Director of the United States Patent and Trademark Office*